US005857628A

United States Patent [19]

Kubach

[11] Patent Number: 5,857,628

[45] Date of Patent: Jan. 12, 1999

[54] NOZZLE PLATE, PARTICULARLY FOR FUEL INJECTION VALVES, AND METHOD FOR THE PRODUCTION OF A NOZZLE PLATE

[75] Inventor: Hans Kubach, Hemmingen, Germany

[73] Assignee: Robert Bosch GmbH, Stuttgart, Germany

[21] Appl. No.: 809,556

[22] PCT Filed: Jun. 4, 1996

[86] PCT No.: PCT/DE96/00980

§ 371 Date: Mar. 6, 1997

§ 102(e) Date: Mar. 6, 1997

[87] PCT Pub. No.: WO97/07332

PCT Pub. Date: Feb. 27, 1997

[30] Foreign Application Priority Data

Aug. 17, 1995 [DE] Germany ..... 195 30 193.5

[51] Int. Cl.[6] ..... B05B 1/00

[52] U.S. Cl. ..... 239/596

[58] Field of Search ..... 239/590.3, 590.5, 239/585.1–585.5, 533.3, 533.9, 533.12, 596

[56] References Cited

U.S. PATENT DOCUMENTS 4,798,505 1/1989 Ameseder .

5,516,047 5/1996 Kubach et al. ..... 239/585.5

5,730,368 3/1998 Flik et al. ..... 239/900 X

FOREIGN PATENT DOCUMENTS 4404021 8/1995 Germany .

*Primary Examiner*—Lesley D. Morris

*Attorney, Agent, or Firm*—Kenyon & Kenyon

[57] ABSTRACT

A nozzle plate (10), particularly for fuel injection valves, with at least one flow path which has at least one supply opening (12), which path comprises a ring gap (15) which opens into a ring-shaped exit opening (19), as well as a method for the production of such a nozzle plate (10). For the nozzle plate (10), it is provided that the flow path has a ring channel (14) assigned to the supply opening (12), which channel makes a transition into a cylinder-shaped ring gap (15) with a cross-section which narrows in the region of the exit opening (19, 19'). The production of the nozzle plate (10) takes place in that a cavity mold (30) corresponding to the flow path through the nozzle plate (10) is produced, that a layer (44) embedding the cavity mold (30) is galvanically deposited, and that the cavity mold (30) is removed from the galvanically deposited layer (44).

7 Claims, 3 Drawing Sheets

FIG. 1
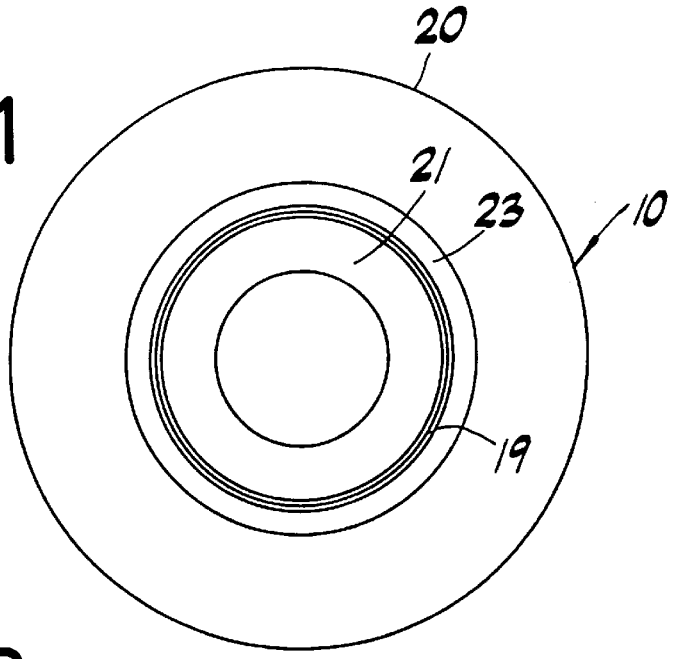
FIG. 2
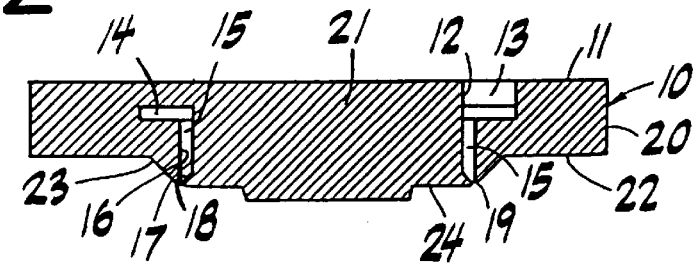
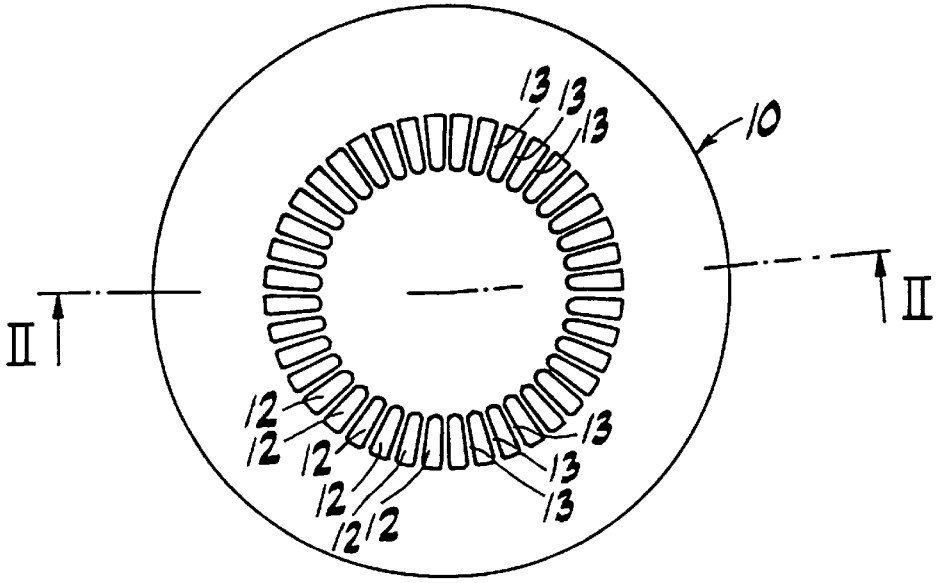
FIG. 3

NOZZLE PLATE, PARTICULARLY FOR FUEL INJECTION VALVES, AND METHOD FOR THE PRODUCTION OF A NOZZLE PLATE

BACKGROUND INFORMATION

A known nozzle plate (German Patent No. DE 43 28 418 A1) has a holder plate with a stepped through-bore, where the segment of this bore which lies towards the supply side, and has a smaller diameter, forms the supply opening. An injection plate is inserted into the bore segment with the larger diameter, which plate has a recess in its edge region assigned to the exit side, forming a ring channel together with a recess in the holder plate assigned to it, which channel is connected with the supply opening via slits provided in the side of the injection plate facing the supply opening. The exit-side edges of the recesses in the holder plate and the injection plate delimit a ring-shaped exit opening of the known nozzle plate.

The German patent application P 44 04 021.0 describes another nozzle plate, composed of two parts, in which a ring channel is provided between the two parts, which channel is connected with a fuel supply region via supply bores provided in the first part, and connected with a fuel exit region via a ring gap. The ring gap, in this connection, is delimited by two mantle surfaces in the shape of truncated cones, with the one being attached to the first part of the nozzle plate and the other to the second part.

The two parts of this nozzle plate are produced by galvanic second-casting of corresponding negative molds, consisting of conductive plastic, where the galvanically cast parts can be mechanically finished and subsequently attached to each other by means of gluing, diffusion soldering, or diffusion welding.

Such nozzle plates with ring gap nozzles are used in fuel injection valves for gasoline engines in order to achieve better atomization of the fuel. In this connection, the fuel is supposed to exit as a cohesive laminar jet in the shape of a conical mantle. Because of the radial expanse along the conical mantle, the fuel film becomes thinner with an increasing diameter towards the exit, until it bursts into very small droplets due to aerodynamic forces. In this manner, it is possible to achieve distribution of the fuel over a relatively large volume.

In order to obtain a uniform laminar jet, both uniform pressure distribution and a uniform fuel supply are necessary at the ring gap.

SUMMARY OF THE INVENTION

The nozzle plate according to the present invention, has the advantage, in contrast, that it is possible to achieve a uniform, cohesive laminar jet in the shape of a conical mantle at the fuel discharge, by means of the cylindrical formation of the ring channel, with a cross-section which narrows in the region of the exit opening, without an arrangement of the ring gap itself in the shape of a conical mantle being necessary. In this connection, the formation of the ring gap, according to the present invention, results in an improved flow behavior of the fuel in the nozzle plate itself, and in a more uniform formation of the laminar jet.

It is particularly advantageous if two exit openings arranged concentric to one another are provided, where each of the exit openings has its own flow path assigned to it, since this makes it possible to achieve two fuel jets in the shape of a conical mantle, which have a smaller conical angle and break down into smaller fuel droplets over a shorter path length.

With the exit opening, which is lens-shaped in a top view, it is possible to form the fuel jet which is sprayed out in such a way, in advantageous manner, that the fuel flow is divided into two partial flows. This makes it possible, for example, to supply both intake valves of a four-valve engine at the same time.

Another advantage of the present invention consists of the fact that because of the holder ridges arranged between the supply openings, the inner segment which delimits the flow path on the inside can be connected with the ring-shaped segment of the nozzle plate which delimits the flow path on the outside, in a stable manner, without the fuel flow being hampered by the nozzle plate.

In this connection, the supply openings and the holder ridges located between them can also be provided outside the diameter of the ring-shaped exit opening and therefore radially outside the ring gap, which makes it possible to enlarge the flow cross-section of the flow path through the nozzle plate on the supply side, in order to make the flow through the nozzle plate even more uniform.

The method for the production of a nozzle plate has the advantage, in this connection, that the nozzle plate can be made in one piece using this method, so that none of the joining processes which influence the formation of the ring gap, such as gluing, soldering or welding, have to be carried out on the nozzle plate.

In advantageous manner, it is possible to produce the width of the ring gap precisely, by second-casting of a single cavity mold, and it does not depend on the precision with which the connection between two parts is produced. In particular, tolerances in joining and welding together two parts are eliminated. Another advantage consists of the fact that the nozzle plate can be produced with two ring gaps which serve as exit openings, each with its own flow path, without significant additional effort.

A particular advantage of the method according to the present invention consists of the fact that the die for the production of the cavity mold can easily be produced by mechanical lathing work, e.g. with a diamond-tipped tool, with great precision. The slant of the inside wall of the ring gap, which is necessary for formation of the laminar jet to discharge the fuel, can be produced with great precision, by finishing a die part from the outside.

BRIEF DESCRIPTION OF THE DRAWINGS

Exemplary embodiments of the invention are shown in the drawing and will be described in greater detail below. The drawing shows:

FIG. 1 a top view of the exit side of a first exemplary embodiment of a nozzle plate according to the present invention, FIG. 2 a cross-section, essentially along the line II—II in FIG. 3, through the nozzle plate according to FIG. 1, FIG. 3 a top view of the supply side of the nozzle plate according to FIG. 1, FIG. 4 a cross-section through an injection mold for the production of a cavity mold, which serves for the production of the nozzle plate according to FIGS. 1 to 3, FIG. 5 a cross-section corresponding to FIG. 4, where the top die of the injection mold has been removed and the cavity mold has been affixed on an auxiliary carrier, FIG. 6 a cross-section through a cavity mold embedded in a galvanically deposited layer, FIG. 7 a cross-section corresponding to FIG. 6, through the galvanically deposited layer, where the cavity mold has been removed, FIG. 8 a cross-section through a nozzle plate corresponding to FIG. 2, with a connector element of a fluid supply and flow measurement device set onto it, FIG. 9 a cross-section through a cavity mold for a nozzle plate with two ring gaps, attached to an auxiliary carrier, FIG. 10 a cross-section similar to FIG. 8, through a nozzle plate produced with the cavity mold according to FIG. 9, and FIG. 11 a schematic top view of a lens-shaped ring gap.

DETAILED DESCRIPTION

Figure 4:
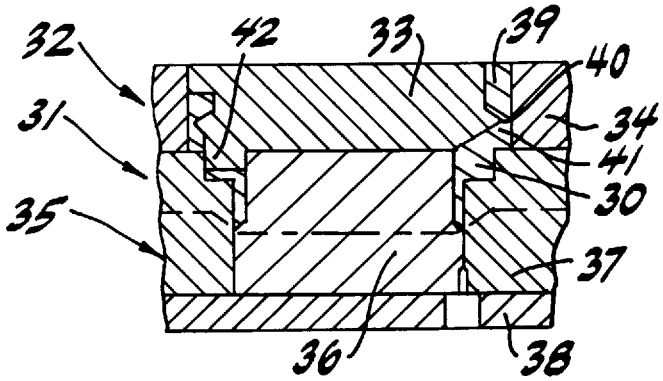

The nozzle plate 10 in FIGS. 1 to 3, produced according to the present invention, consists of a material which can be galvanically deposited, particularly of a metal or a metal alloy, preferably of nickel-phosphorus, and has a flat surface 11 on the supply side, shown at the top in FIG. 2, in which a plurality of supply openings 12 is provided, as shown in FIG. 3, which are separated from one another by means of holder ridges 13 located between them. The ring-shaped supply openings 12, which are arranged at a uniform distribution over the circumference, open into a ring channel 14, which makes a transition into a cylindrical ring gap 15 in the flow direction.

The ring gap 15 is delimited, on its outside circumference, by a cylindrical mantle surface 16, and, on its inside circumference, by a cylindrical mantle surface 17, which makes a transition into a conical mantle surface 18 in the region of a ring-shaped exit opening 19, so that the ring gap 15 narrows uniformly towards the exit opening 19.

The nozzle plate 10 therefore has a ring-shaped segment 20 which is located outside the ring gap 15, which is connected, in one piece, with an inner segment 21 located within the ring gap 15, via the holder ridges 13. On the exit side, the nozzle plate 10 has a ring surface 22 which lies parallel to the surface 11, and makes a transition into a truncated conical mantle surface 23, which extends at least to the exit opening 19. It is also possible, however, that the truncated conical mantle surface 23 on the ring-shaped segment 20 extends beyond the ring-shaped exit opening 19 of the ring gap 15, to the inner segment 21. Towards the center of the nozzle plate 10, the truncated conical mantle surface 23 is followed by another flat surface 24, which lies parallel to the supply-side surface 11, either directly or separated by the ring gap. The surface 24 can be a ring-shaped surface, as in the exemplary embodiment shown. It is also possible, however, to structure the flat surface 24 as a circular surface.

For the production of the nozzle plate 10 described, as shown in FIG. 4, first a cavity mold 30 is produced from plastic, for example a thermoplastically formable and releasable plastic, particularly PMMA (polymethyl methacrylate), preferably using the injection-molding process. In this connection, the cavity mold 30 corresponds to the flow path through the nozzle plate 10 to be produced, formed by the supply openings 12, the ring channel 14, and the ring gap 15.

The inject ion-molding process is carried out, in this connection, using an appropriate molding die 31, which comprises a top die part 32 with a top inner core 33, and a top outside ring 34, as well as a bottom die part 35 with a bottom inner core 26, a bottom outside ring 37, and a die plate 38. For the simultaneous formation of several cavity molds 30, the top die part 32 can have several inner cores 33, in a manner not shown in greater detail, with a corresponding outside ring arrangement. The bottom die part 35 is then structured in a corresponding manner.

The flow path planned for the nozzle plate 10 is formed between the bottom inner core 36 and the bottom outside ring 37, which are carried by the die plate 38. An injection-molding supply 39 is formed between the top inner core 33 and the top outside ring 34, which supply makes a transition, via a narrow area 40 which produces a predetermined breaking point, into a casting space for a support ring 41, which serves as the carrier element for the cavity mold 30 during further production of the nozzle plate 10.

Furthermore, continuations 42 corresponding to the holder ridges 13 of the nozzle plate 10 are provided on the top inner core 33, which continuations engage in a region between the bottom outside ring 37 and the bottom inner core, thereby establishing the regions for the supply openings 12. On the bottom inner core 36 of the mold die 31, the cylindrical mantle surface and the conical mantle surface which delimit the ring gap 15 towards the inside are formed as outside surfaces, which can therefore be formed with great precision.

After injection of the plastic into the cavity of the mold die 31 which reproduces the flow path of the nozzle plate 10, for production of the cavity mold 30 with the attached support ring 41, the top die part 32 is removed, together with the excess plastic material located in the injection supply 39.

Figure 5:
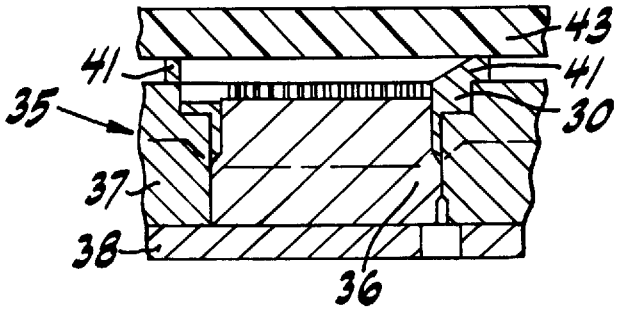
Figure 6:
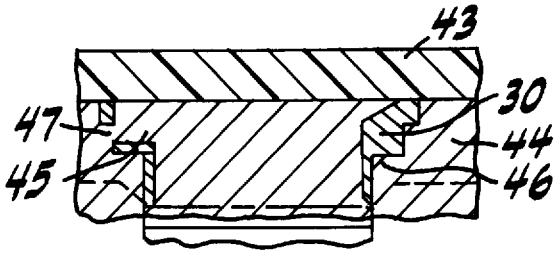

Then, as shown in FIG. 5, a conductive plastic plate of PMMA, preferably reinforced with a metal grid, is attached, particularly welded on, as an auxiliary carrier, while the cavity mold 30 is still in the bottom die part 35. This makes it possible to avoid deformations of the cavity mold 30 during attachment of the plastic plate 43. Then the bottom die part 35 is also removed, so that the cavity mold 30 is exposed.

Subsequently, a layer 44, preferably consisting of nickel-phosphorus, is deposited on the conductive plastic plate 43, completely embedding the cavity mold 30. Defects which can occur as the layer grows in the region 45 of the ridges 13, when filling the edges in the transition region 46 between the ring channel 14 and the ring gap 15, as well as when the layer 44 grows together in the outside region 47 of the ridges 13, are insignificant in this connection, since the formation of the ring gap 15 on the exit side is not influenced by such defects.

After galvanic deposition of the layer 44, from which the nozzle plate 10 is later formed, the plastic plate 43 which serves as an auxiliary carrier during galvanization is removed, and the supply-side surface 11 of the nozzle plate 10 is produced by grinding.

Figure 7:
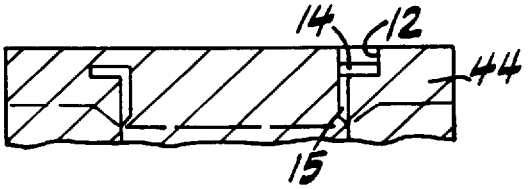

Finally, as shown in FIG. 7, the cavity mold 30 is removed by removing the plastic, so that the flow path formed in the galvanically deposited layer 44, by the supply openings 12, the ring channel 14, and the ring gap 15, is exposed.

Figure 8:
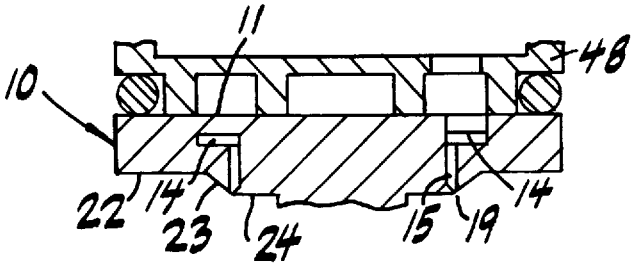

As shown in FIG. 8, finally the surface of the galvanically deposited layer 44 which corresponds to the exit side of the nozzle plate 10 to be formed, is finished by means of a material-removing process, in order to form the ring surface 22, the truncated conical mantle surface 23 which extends over the exit opening, and the flat surface 24 which is located on the inside segment 21 of the nozzle plate.

During finishing of the truncated conical mantle surface 23 which preferably extends over the exit opening 19, in order to adjust the exit opening 19 in such a way that the flow path through the nozzle plate 10 demonstrates the necessary flow resistance, a connector element 48 of a fluid supply and flow-through measurement device, not shown in greater detail, is set onto the supply-side surface 11 of the nozzle plate 10 to be formed, so that a fluid can be supplied to the supply side of the nozzle plate 10 at constant pressure. During finishing of the truncated conical mantle surface 23, the exit opening 19 is exposed and constantly enlarged, so that the flow through the nozzle plate 10, which is being finished, increases until it has reached the desired value. Now the exit opening 19 has the necessary size.

The finishing process, which involves material removal or cutting, preferably takes place with a tool tipped with natural diamond, which makes it possible to cleanly form the edges of the ring gap 15 which delimit the exit opening 19.

In order to obtain edges of the ring gap which are as free of burrs as possible, finishing of the exit side of the nozzle plate 10 can be carried out while the flow path is still filled with the cavity mold 30. In this case, the necessary size of the exit opening 19 is measured optically, for example.

The method described can be used for the production of an individual nozzle plate 10, but it is practical if several nozzle plates 10 are produced at the same time with this method, in such a way that several cavity molds 30 are simultaneously formed using the injection-molding method, and are affixed to a common auxiliary carrier. The layer from which the individual nozzle plates 10 are then produced is then deposited in a single galvanization step. It is practical if parting molds are provided between the cavity molds 30 for the flow path of the nozzle plates, so that when the surface of the galvanically deposited layer 44 which is assigned to the exit side of the nozzle plates 10 is being finished, the nozzle plates 10 to be formed from it can be separated in simple manner.

Figure 9:
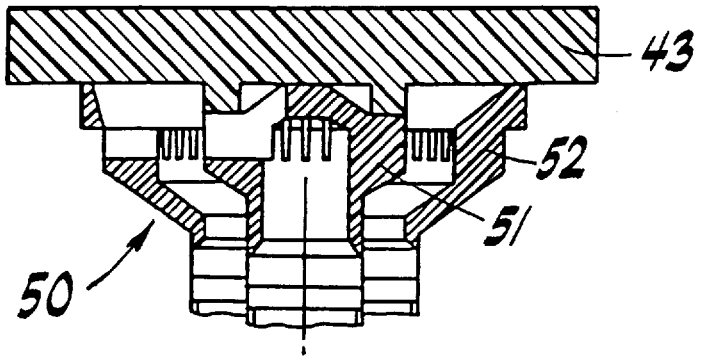

FIG. 9 shows a cavity mold 50 for a nozzle plate 10' according to a different exemplary embodiment of the present invention, with an inner mold part 51, corresponding to a first flow path through the nozzle plate 10', and an outer mold part 52, corresponding to a second flow path through the nozzle plate 10'. It is practical if the mold parts 51, 52 are arranged concentric to one another, i.e. if the corresponding flow paths are formed in accordance with the first exemplary embodiment of the invention described on the basis of FIGS. 1 to 8.

Figure 10:
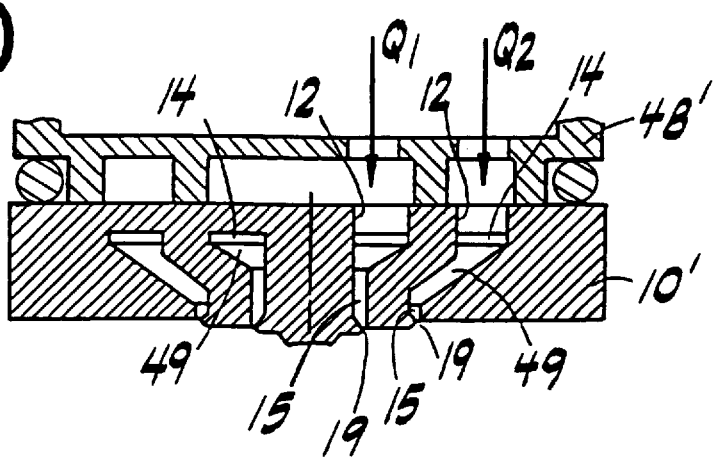

FIG. 10 illustrates finishing of the exit side of a nozzle plate 10' produced with the cavity mold 50 according to FIG. 9, in which a connector element 48' of a fluid supply and flow-through measurement device is set on, in order to determine the size of the exit opening 19 during finishing of the exit side of the nozzle plate 10'. It is practical if the connector element 48' is designed in such a way, in this connection, that the flow through each of the two exit openings can be determined separately, as indicated by the arrows Q1 and Q2.

In order to create the largest possible supply region for each of the two flow paths through the nozzle plate 10', and, on the other hand, to be able to arrange the ring gaps 15 with a relatively small diameter, close to one another, connector channels 49 in conical mantle shape are formed between the ring gaps 15 and the ring channels 14.

Here, the supply openings 12 in each instance, with the related holder ridges 13, lie radially outside the corresponding exit opening 19 and therefore also radially outside the corresponding ring channel 15. This arrangement of the supply openings 13 and ring channel 15, which is necessarily required for the nozzle plate 10' according to FIG. 10, can also be provided for the nozzle plate 10 described on the basis of FIGS. 1 to 3, in order to achieve the greatest possible supply-side flow cross-section, which makes a uniform distribution of the flow energy, without variations, possible.

Figure 11:
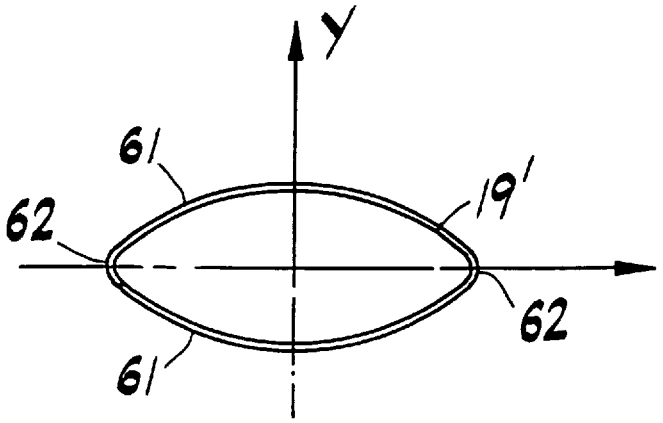

Using the production method described, not only nozzle plates with circular exit openings, but also those that have lens-shaped exit openings 19' can be produced, as shown in FIG. 11. In this connection, the lens-shaped exit opening 19' is composed of two circular arc segments 61 with a large radius of curvature, and two circular arc segments 62 with a small radius of curvature, where the two segments 61 with a large radius of curvature lie opposite one other with their concave sides, and are connected with one another at their ends via the segments 62 with a small radius of curvature. The circular arc segments 61 with a large radius of curvature lie symmetrical to an axis X, while the circular arc segments 62 with a small radius of curvature are arranged symmetrical to an axis Y.

The fuel flow which flows through the nozzle can be divided into two mass flows, separated from each other in the direction of the Y axis, by means of a ring gap nozzle with a lens-shaped exit opening arranged in accordance with FIG. 11, since the fuel jet given off in the direction of the X axis, via the corresponding segments of the exit opening, breaks up sooner than the one given off in the Y direction. Such a ring gap nozzle is practical, for example, if two inlet valves of a cylinder of a four-valve engine, in each instance, are to be supplied with fuel at the same time.

What is claimed is:

1. A nozzle plate for a fuel injection valve, having at least one flow path, comprising:

a top surface having at least one supply opening;

a bottom surface having at least one ring-shaped exit opening; and a ring channel connecting the supply opening to the ring-shaped exit opening, wherein the ring channel makes a transition into a cylinder-shaped ring gap having a cross-section which narrows in a region of the ringshaped exit opening.

2. The nozzle plate according to claim 1, wherein the ring gap is delimited in the region of the ring-shaped exit opening by the bottom surface which further comprises:

an outside cylindrical mantel surface having a first sharp edge which determines a first side of the ring-shaped exit opening; and an inside conical mantle surface having a second sharp edge which determines a second side of the ring-shaped exit opening.

3. The nozzle plate according to claim 1, wherein the at least one ring-shaped exit opening includes a plurality of ring-shaped exit openings, each one of the plurality of ring-shaped exit openings is arranged in a concentric manner so that the ring-shaped exit openings are next to one another, and each one of the plurality of ring-shaped exit openings is connected in its own separate flow path to each one of the plurality of supply openings by a ring channel and a ring gap.

4. The nozzle plate according to claim 1, wherein the exit opening is lens-shaped.

5. The nozzle plate according to claim 4; wherein the lens-shaped exit opening comprises:

a first pair of circular arc segments with a first radius of curvature, each of the first pair of circular arc segments having a first end and a second end; and a second pair of circular arc segments with a second radius of curvature smaller than the first radius of curvature, each of the second pair of circular arc segments having a first end and a second end; and wherein one of the first pair of circular arc segments is connected at both its first end and second end to the first end of each one of the second pair of circular arc segments, and the second end of each one of the second pair of circular arc segments is respectively connected to a first end and second end of the second one of the first pair of circular arc segments, so that each pair of the circular arc segments which correspond in size to one another are positioned opposite the other so that a concave side of each pair of circular arc segments faces the other.

6. The nozzle plate according to claim 1, wherein the at least one supply opening includes a plurality of supply openings, and the plurality of supply openings are arranged in a uniform concentric manner along a circumference of the nozzle plate, and further comprising:

an inside segment connected to an inside of each one of the plurality of supply openings and which delimits the flow path on the inside;

a ring-shaped segment connected to an outside of each one of the plurality of supply openings and which delimits the flow path on the outside; and a plurality of holder ridges arranged between the plurality of supply openings and which mechanically connect the inside segment and the ring-shaped segment.

7. The nozzle plate according to claim 6, wherein the plurality of supply openings and the plurality of holder ridges are positioned radially outside a position of the cylinder-shaped ring gap.

* * * * *